US005348355A

United States Patent [19]

Oyha

[11] Patent Number: 5,348,355

[45] Date of Patent: Sep. 20, 1994

[54] AUTOMOTIVE ENGINE HOOD LATCH MECHANISM

[75] Inventor: Takeji Oyha, Hiroshima, Japan

[73] Assignee: Mazda Motor Corporation, Hiroshima, Japan

[21] Appl. No.: 988,166

[22] Filed: Dec. 9, 1992

[30] Foreign Application Priority Data

Dec. 11, 1991 [JP] Japan ..... 3-109854[U]
Dec. 11, 1991 [JP] Japan ..... 3-109855[U]
Dec. 12, 1991 [JP] Japan ..... 3-110166[U]

[51] Int. Cl.[5] ..... E05C 19/12
[52] U.S. Cl. ..... 292/11; 292/216; 292/DIG. 56
[58] Field of Search ..... 292/11, 216, 341.12, 292/DIG. 56, DIG. 65, 304

[56] References Cited

U.S. PATENT DOCUMENTS 2,316,692 4/1943 Hill ..... 292/DIG. 14 X
4,045,064 8/1977 Okada ..... 292/DIG. 14 X
4,073,519 2/1978 Kurozu et al. ..... 292/DIG. 56 X
4,875,724 10/1989 Gruber ..... 292/DIG. 14 X
4,936,611 6/1990 Palvölgyi ..... 292/DIG. 14 X
4,961,601 10/1990 Lindholm et al. ..... 292/DIG. 14 X

FOREIGN PATENT DOCUMENTS 243371 3/1990 Japan .

*Primary Examiner*—Rodney M. Lindsey
*Attorney, Agent, or Firm*—Sixbey, Friedman, Leedom & Ferguson

[57] ABSTRACT

An engine hood latch mechanism for locking an engine hood in a closed position includes a striker fixed to the lower surface of the engine hood and a base member having a vertical slit into which the striker is dropped in response to closure of the engine hood. A locking mechanism engages with the striker in response to drop of the striker into the vertical slit and locks the striker in a closing position where it holds the engine hood in the closed position. A hook lever has a hook at one end thereof and is mounted for rotation on the base member at the other end. The hook lever is urged by a spring toward a closing position where the hook closes the entrance of the vertical slit. The spring is connected to the hook lever at a spring connecting portion formed on the hook lever, and a pair of stoppers are formed on the base member on opposite sides of the spring connecting portion to abut against the spring connecting portion in response to rotation of the hook lever, thereby determining the closing position of the hook lever and limiting rotation of the hook lever away from the vertical slit.

11 Claims, 7 Drawing Sheets

AUTOMOTIVE ENGINE HOOD LATCH MECHANISM

BACKGROUND OF THE INVENTION

1. Field of the Invention

This invention relates to an automotive engine hood latch-mechanism for latching an engine hood of a vehicle.

2. Description of the Prior Art

As shown in FIG. 14, in the engine hood latch mechanism disclosed in Japanese Unexamined Utility Model Publication No. 2(1990)-43371, a vertical slit B is formed in a latch base member A fixed to the vehicle body and a striker C fixed to the engine hood is dropped into the vertical slit B and is brought into engagement with a fork lever in response to closure of the engine hood. The fork lever is locked in the position by a claw lever to lock the engine hood in the closed position. By releasing the fork lever from the claw lever, the engine hood can be opened.

In such a latch mechanism, a hook lever E sometimes mounted on the latch base A to be rotatable about a pivot D. The hook lever E is held in the position shown by the solid line under the force of a spring F, where it abuts against the striker C and closes the entrance of the vertical slit B. With this arrangement, the engine hood cannot abruptly lift even if the vehicle runs with the latch mechanism in an unlatched state since the striker C is once engaged with the hook lever E before it comes off the vertical slit B.

The hook lever E is moved between the closed position shown in the solid line where the hook portion e1 thereof closes the entrance of the vertical slit B and the open position shown by the chained line where the hook portion e1 is away from the vertical slit B. In order to limit the swinging range of the hook lever E, a pair of stopper portions g1 and g2 are formed by cutting and bending parts of the latch base A and a stopper lever portion e2 formed on the hook lever E is inserted between the stopper portions g1 and g2.

The hook lever E is generally stamped out from a sheet metal, and accordingly, when the stopper lever portion is formed on the hook lever E, the size of the hook lever E is enlarged and a number of hook lever E which can be obtained from a sheet metal is reduced.

SUMMARY OF THE INVENTION

In view of the foregoing observations and description, the primary object of the present invention is to provide an automotive engine hood latch mechanism in which the hook lever can be small in size and can be stamped out from a sheet material at a high yield.

The engine hood latch mechanism in accordance with the present invention is characterized in that the spring for urging the hook lever toward the closed position is connected to the hook lever at a spring connecting portion formed on the hook lever, and a stopper means which determines the closing position of the hook lever and limits rotation of the hook lever away from the vertical slit comprises the spring connecting portion and a pair of stoppers which are formed on the latch base member on opposite sides of the spring connecting portion of the hook lever and are adapted to abut against the spring connecting portion in response to rotation of the hook lever.

With this arrangement, the hook lever can be small in size since the spring connecting connecting portion doubles as the stopper lever portion.

In one preferred embodiment of the present invention, the latch base member and the hook lever are stamped out from sheet metals, the spring connecting portion is formed by cutting a part of the hook lever and bending the part substantially at right angle to the surface of the hook lever, and each of said stoppers is formed by cutting a part of the base member and bending the part substantially at right angle to the surface of the base member. The stoppers and the spring connecting portion are arranged relative to each other so that the spring connecting portion abuts against each of the stoppers in surface-to-surface contact. With this arrangement, the surface pressure upon impact of the spring connecting portion against the stopper is reduced. When the surface pressure is large, the hook lever and/or the stoppers or antirust coating thereon can be damaged.

DESCRIPTION OF THE PREFERRED EMBODIMENTS

Figure 1:
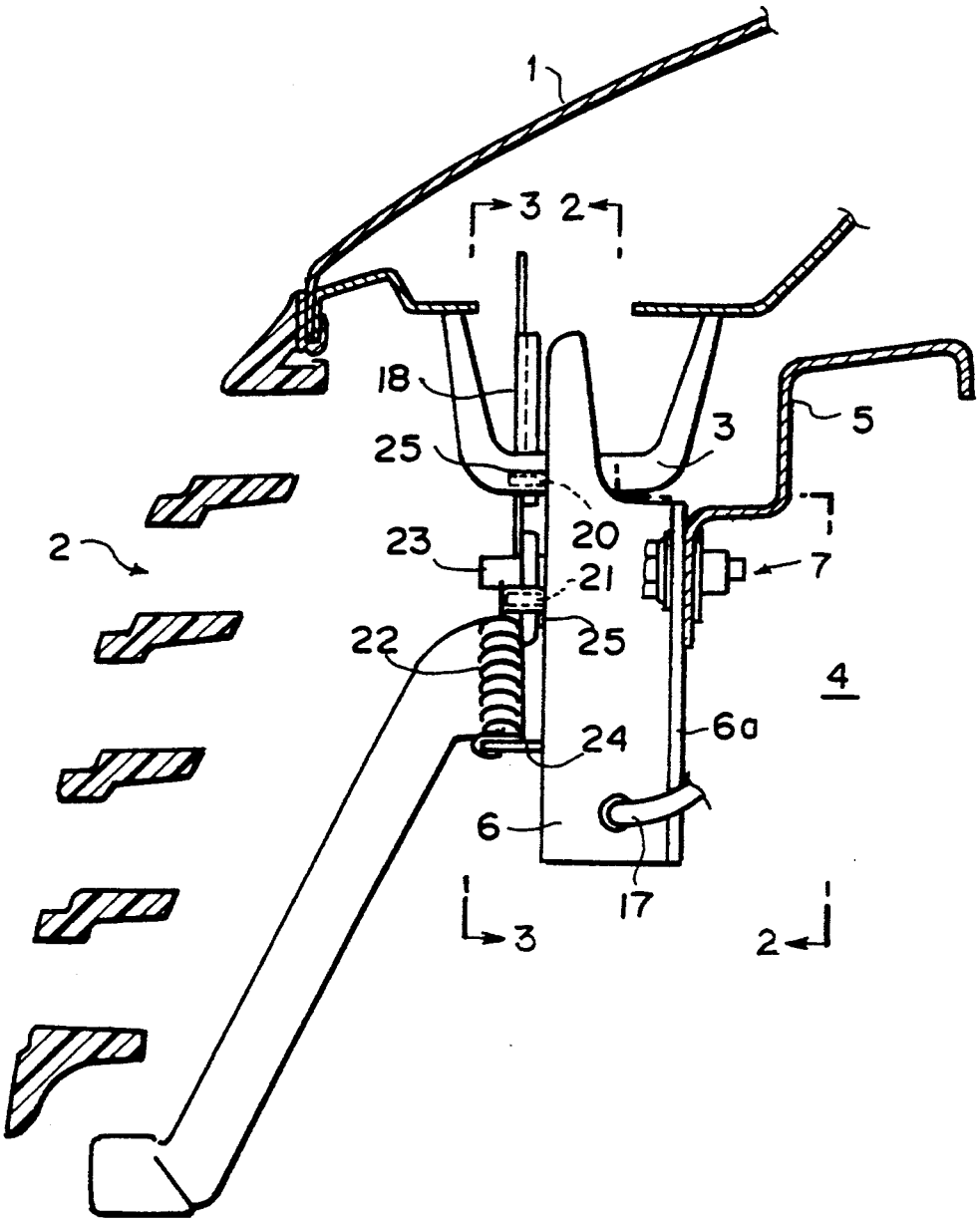
FIG. 1 is a schematic cross-sectional view of a front part of a vehicle provided with an engine hood latch mechanism in accordance with an embodiment of the present invention.

In FIG. 1, a U-shaped striker 3 is mounted on the lower side of a front portion of an engine hood 1 of a vehicle to extend in the longitudinal direction of the vehicle. Reference numeral 2 denotes a front grill. A shroud upper 4 extends in the transverse direction in an engine room 4. A latch base member 6 is mounted on the shroud upper 5. The latch base member 6 is substantially U-shaped in a horizontal cross-section and has left and right wing portions 6*a*. The latch base member 6 is mounted on the shroud upper 5 by fixing the left and right wing portions 6*a* by suitable fasteners 7 such as bolts and nuts.

The latch base member 6 is provided with a vertical slit 8 formed therein to extend from the upper edge thereof at the center thereof. When the engine hood 1 is closed, the striker 3 is dropped into the vertical slit 8.

Figure 2:
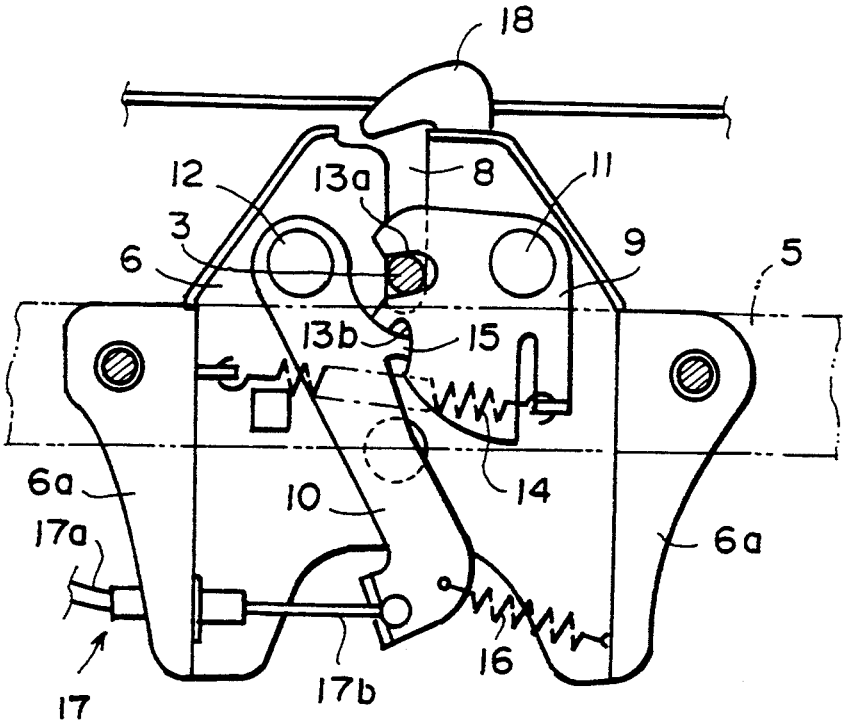
FIG. 2 is a view taken in the direction of arrows A—A in FIG. 1, FIG. 3 As a view taken in the direction of arrows B—B in FIG. 1.

As shown in FIG. 2, a fork lever 9 and a claw lever 10 are mounted on the rear side of the latch base member 6 on opposite sides of the vertical slit 8 to be rotatable about pivot pins 11 and 12, respectively. The fork lever 9 is provided with a fork portion 13*a* and a lock portion 13*b* which are in the form of recesses. When the striker 3 is out of the vertical slit 8, the fork lever 9 is held in an open position where the fork portion 13*a* opens upward in the vertical slit 8 under the force of a spring 14 provided between the latch base member 6 and the fork lever 9. When the striker 3 is dropped into the vertical slit 8, the striker 3 is engaged with the fork portion 13*a* and rotates downward the fork lever 9 to a lock position, where the fork lever 9 locks the striker 3 and accordingly the engine hood 1 in the closed position.

The claw lever 10 holds the fork lever 9, which is in engagement with the striker 3, in the lock position. The claw lever 10 is provided with a claw 15 on the side facing the fork lever 9 and is urged by a spring 16, provided between the claw lever 10 and the latch base member 6, so that the claw 15 is in contact with the peripheral surface of the fork lever 9. Accordingly, when the fork lever 9 is rotated downward by the striker 3, the claw 15 is brought into engagement with the lock portion 13*b* of the fork lever 9 and locks the fork lever 9 in the lock position.

The claw lever 10 is connected to an engine hood opener (not shown) disposed in the passenger room by way of a cable 17. The cable 17 comprises an outer tube 17*a* and an inner wire 17*b* which is slidably sheathed in the outer tube 17*a*, and one end of the outer tube 17*a* is fixed to the latch base member 6 and one end of the inner wire 17*b* is connected to the claw lever 10. When the inner wire 17*b* is pulled from the inside of the passenger room, the claw lever 10 is rotated in the clockwise direction from the position shown in FIG. 2 and the claw 15 is disengaged from the lock portion 13*b*.

Figure 3:
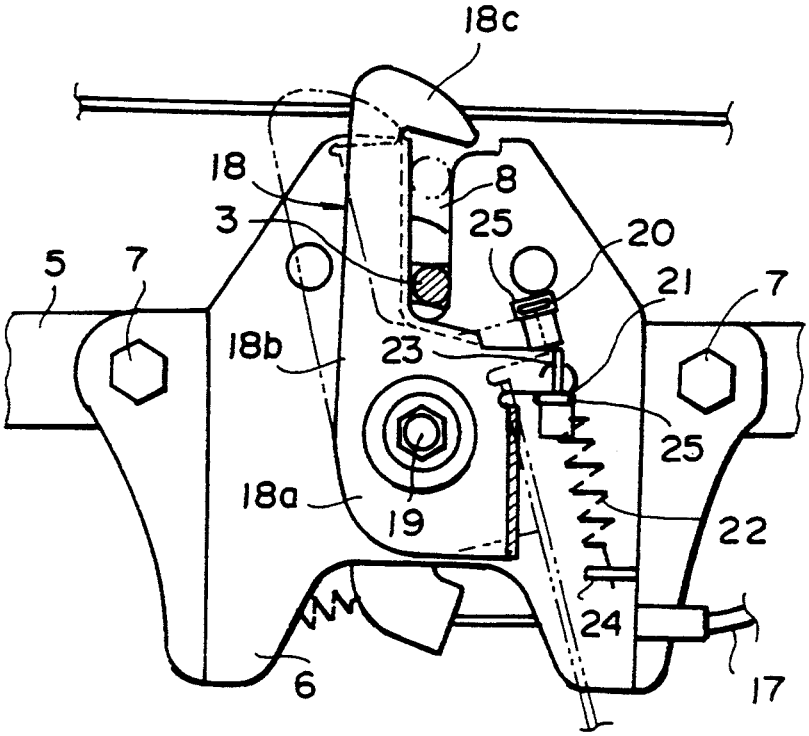

As shown in FIG. 3, a hook lever 18 is mounted on the front side of the latch base member 6. The hook lever 18 is rotatable about a shaft 19. The hook lever 18 comprises a base portion 18*a* at which the hook lever 18 is supported for rotation by the shaft 19, a neck portion 18*b* extending from the base portion 18*a*, a hook portion 18*c* formed on the free end portion of the neck portion 18*b* and a stopper lever portion 23 which is bent forward from the base portion 18*a* in L-shape. A pair of stoppers 20 and 21 are formed by cutting and bending parts of the latch base member 6 and the stopper lever portion 23 of the hook lever 18 is inserted between the stoppers 20 and 21, whereby rotation of the hook lever 18 is limited by engagements between the stopper 20 and the stopper lever portion 23 and between the stopper 21 and the stopper lever portion 23. The hook lever 18 is urged toward the closing position shown by the solid line in FIG. 3 by a spring 22. In the closing position, the stopper lever portion 23 of the hook lever 18 abuts against the stopper 21, the neck portion 18*b* extends along the vertical slit 8 of the latch base member 6 and the hook portion 18*c* closes the entrance of the vertical slit 8. One end of the spring 22 is engaged with a hole 23*a* (FIG. 4) formed in the stopper lever portion 23 of the hook lever 18 and the other end of the spring 22 is engaged with an engagement portion 24 formed on the latch base member 6.

Figure 4:
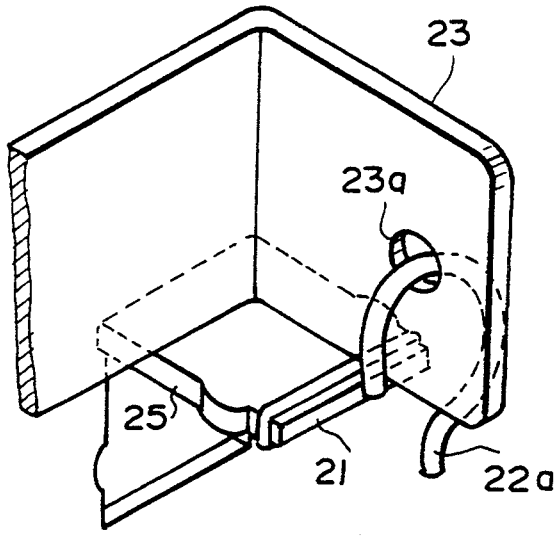
FIG. 4 is an enlarged fragmentary perspective view showing a part of the hook lever.

The stoppers 20 and 21 are directed so that the stopper lever portion 23 abuts against the stoppers 20 and 21 in surface-to-surface contact and a tubular rubber member 25 is fitted on each of the stoppers 20 and 21 as shown in FIG. 4.

When the engine hood 1 is closed, the striker 3 abuts against the hook portion 18*c* of the hook lever 18 from above and enters the vertical slit 8 while forcing the hook lever 18 to the position shown by the chained line in FIG. 3 overcoming the force of the spring 22. Then the striker 3 is engaged with the fork portion 13*a* of the fork lever 9 and rotates downward the fork lever 9, whereby the claw 15 of the claw lever 10 is engaged with the lock portion 13*b* of the fork lever 9 to lock the fork lever 9 in the lock position and the engine hood 1 is locked in the closed position.

When the inner wire 17*b* of the cable 17 is pulled, the claw lever 10 is rotated in the clockwise direction in FIG. 2 overcoming the force of the spring 16 and the claw 15 is released from the lock portion 13*b* of the fork lever 9, whereby the striker 3 is permitted to move upward.

When the engine hood 1 is closed and opened, the stopper lever portion 23 of the hook lever 18 impacts against the stoppers 21 and 20. The rubber members 25 fitted on the stoppers 20 and 21 absorb the impact and reduce noise produced in response to impact of the stopper lever portion 23 against the stoppers 20 and 21. Further since the stopper lever portion 23 is L-shaped and abuts against the stoppers 20 and 21 in surface-to-surface contact, the surface pressure upon impact is reduced and production of noise is further suppressed.

Figure 5:
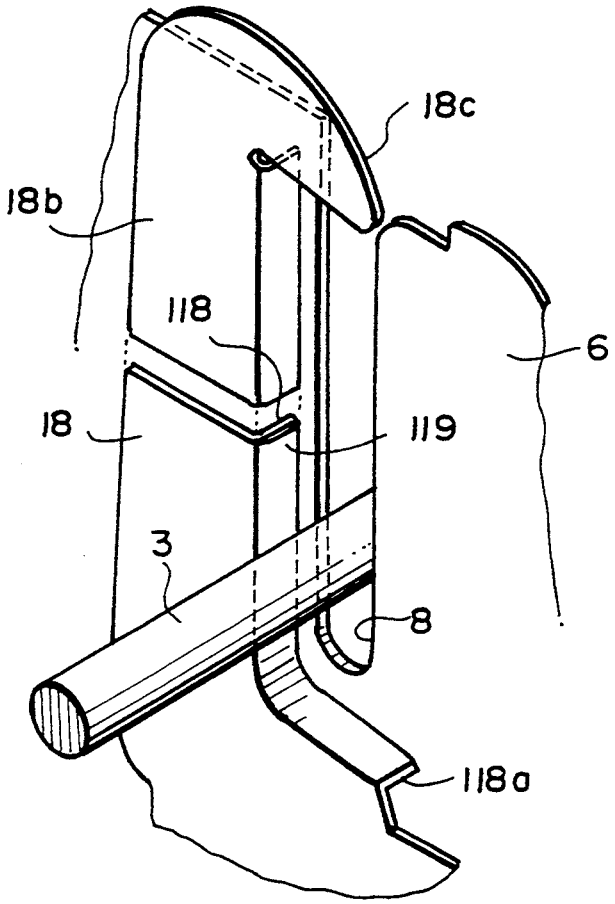
FIG. 5 is an enlarged fragmentary perspective view showing another part of the hook lever.

As shown in FIG. 5, the hook lever 18 is further provided with a striker slide portion 118 which is formed by bending rearward the edge of the hook lever 18 along the neck portion 18*b*. The striker slide portion 118 extends along the vertical slit 8 of the latch base member 6 when the hook lever 18 is in the closed position, and the striker 3 slides along the striker slide portion 118 when it goes into and out of the vertical slit 8. The striker slide portion 118 is provided with a low friction coefficient layer 119 formed of resin of ceramic coated thereon. With this arrangement, the striker 3 can smoothly moves up and down in the vertical slit 8, whereby the striker 3 can stably operates upon closure or opening of the engine hood 1. Since the hook lever 18 is generally formed by stamping, the edge of the hook lever 18 can be rough, which adversely affects the up and down movement of the striker 3. Preferably the low friction coefficient layer 119 has resistance to rust.

Further the edge of the hook lever 18 is bent rearward at a part of the base portion 18*a* as indicated at 118*a* in FIG. 5. The bent portion 118*a* merges into the striker slide portion 118. The purpose of the bent portion 118*a* will be described with reference to FIG. 6, hereinbelow.

Figure 6:
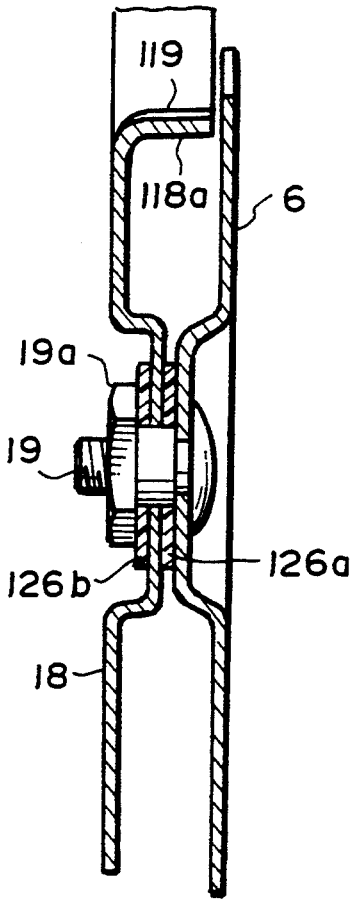
FIG. 6 is a fragmentary cross-sectional view showing the bearing portion of the hook lever.

As shown in FIG. 6, the hook lever 18 is mounted for rotation on the latch base member 6 by the shaft 19 and a retainer 19*a*. In order to reduce friction upon rotation of the hook lever 18, a Teflon washer 126*a* is sandwiched between the hook lever 18 and the latch base member 6 and another Teflon washer 126*b* is sandwiched between the hook lever 18 and the retainer 19*a*. The bent portion 118*a* extends over the bearing portion of the hook lever 18. Thus the bent portion 118*a* protects the bearing portion from rain and the like entering through the front grill, thereby preventing rusting.

Figure 7:
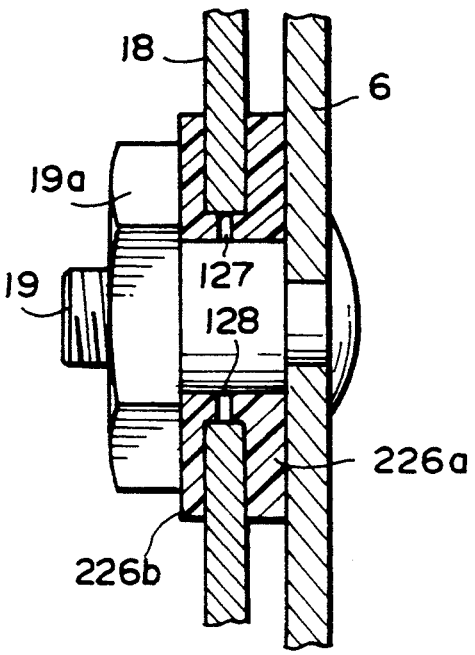
FIGS. 7 and 8 are cross-sectional views respectively showing modifications of the bearing portions.
Figure 8:
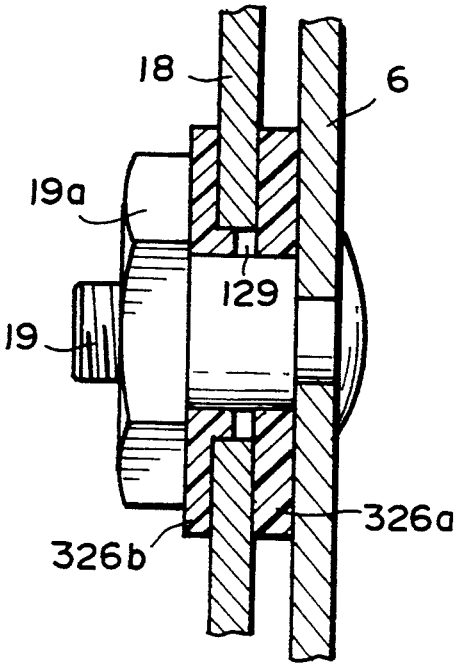

In order to prevent reversing the washers 126*a* and 126*b* by mistake, it is preferred that both the washers 226*a* and 226*b* be provided with protrusions 128 and 127 on their one sides and be incorporated with the protrusions 128 and 127 facing toward each other as shown in FIG. 7. Otherwise, as shown in FIG. 8, one of the washers (326*b*) may be provided with a protrusion 129 and a washer with a protrusion and a washer without protrusion may be used in combination.

Figure 9:
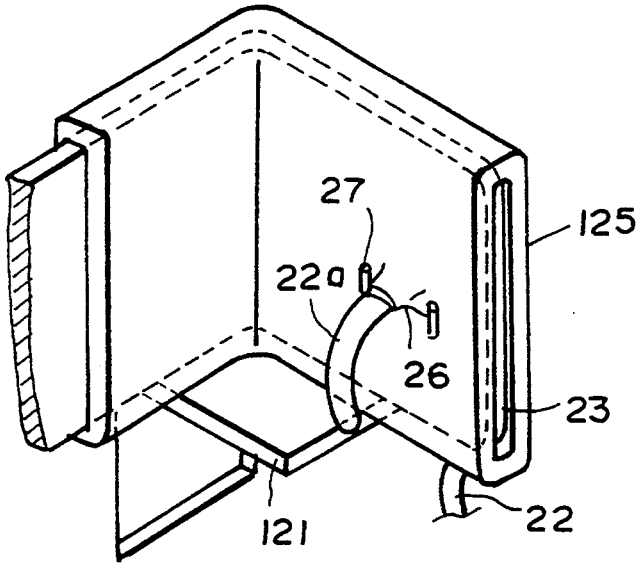
FIG. 9 is a fragmentary perspective view of the stopper lever portion of the hook lever in an engine hood latch mechanism in accordance with a second embodiment of the present invention.
Figure 10:
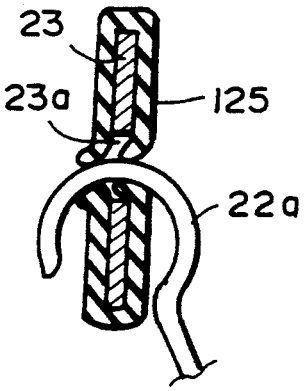
FIG. 10 is a cross-sectional view of FIG. 9.
Figure 11:
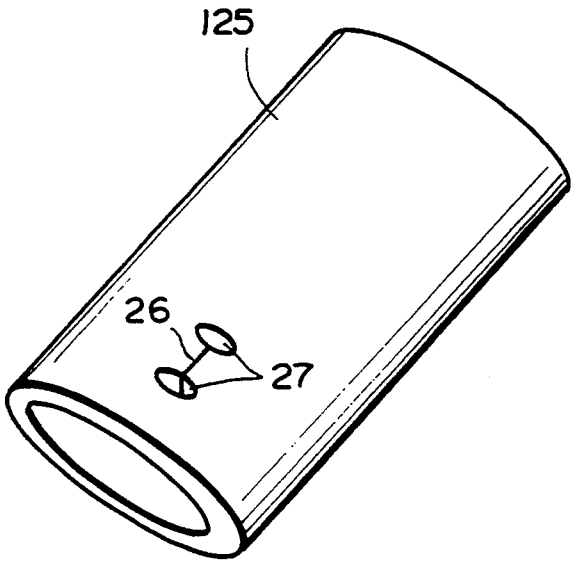
FIG. 11 is a perspective view of the rubber member employed in the second embodiment.

Though, in the embodiment described above, a damper members (rubber members 25) are provided on the stoppers 20 and 21, a damper member is provided on the stopper lever portion 23 in the embodiment shown in FIGS. 9 to 11. The rubber member 125 is tubular in shape as shown in FIG. 11 and is fitted on the stopper lever portion 23 in L-shape as shown in FIG. 9, and a hook 22*a* on the end of the spring 22 is engaged with the stopper lever portion 23 through the rubber member 125. That is, a pair of notches 26 on opposite sides of the stopper lever portion 23 and the hook 22*a* of the spring 22 is passed through the hole 23*a* of the stopper lever portion 23 through the notch 26 on one side of the rubber member 125 and then projects outward through the notch 26 on the other side of the rubber member 125. In order to facilitate deformation of the rubber member 125, a pair of small holes 27 are formed on opposite ends of each notch 26.

Also in this embodiment, the rubber member 125 absorbs the impact and reduce noise produced in response to impact of the stopper lever portion 23 against the stoppers 20 and 21.

Further, in this embodiment, since the rubber member 125 is bent in L-shape along the stopper lever portion 23, the rubber member 125 is firmly held on the stopper lever portion 23. Further, when the hook 22*a* of the spring 22 is inserted into the hole 23*a* of the stopper lever portion 23, a part of the rubber member 125 deforms along the notch 26 into the hole 23*a* and isolates the hook 22*a* from the peripheral surface of the hole 23*a* as shown in FIG. 10, thereby preventing occurrence of electrolytic corrosion.

Figure 12:
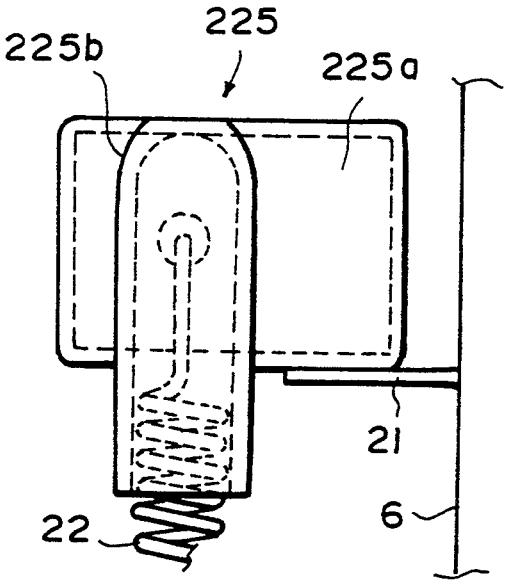
FIG. 12 is a fragmentary side view of the stopper lever portion of the hook lever in an engine hood latch mechanism in accordance with a third embodiment of the present invention.
Figure 13:
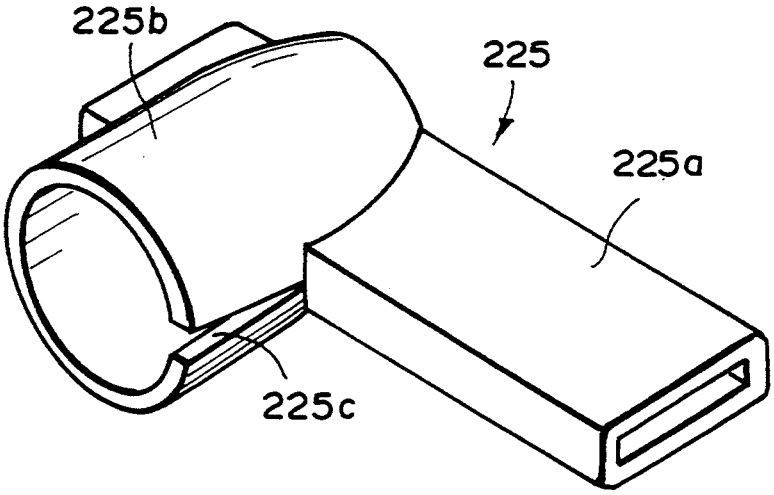
FIG. 13 is a perspective view of the rubber member employed in the third embodiment.
Figure 14:
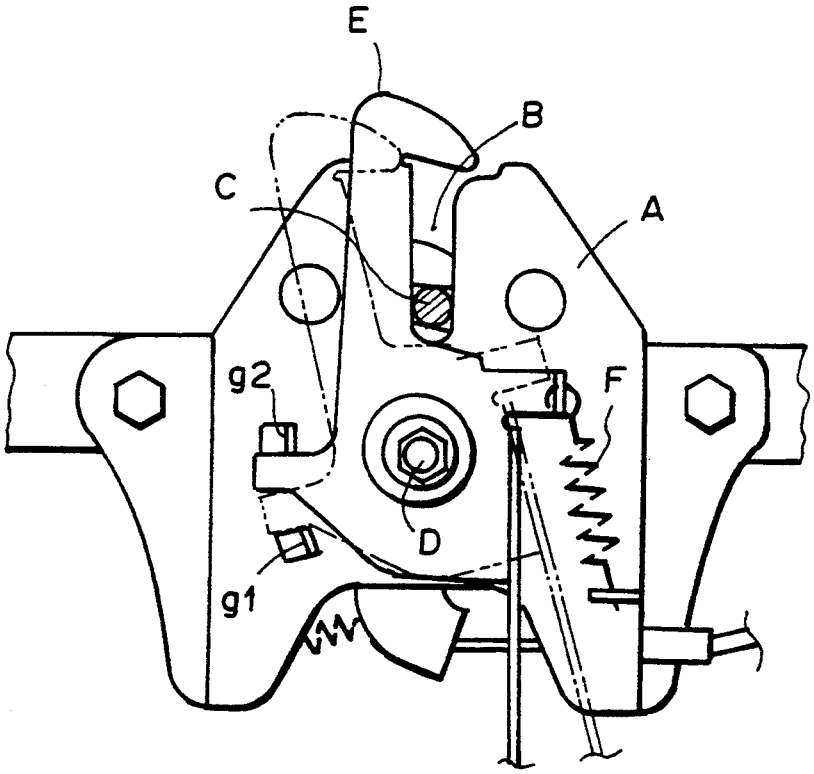
FIG. 14 PRIOR ART
FIG. 14 is a view for illustrating an engine hood latch mechanism in accordance with a prior art.

FIGS. 12 and 13 show a third embodiment of the present invention. In this embodiment, a rubber member 225 comprises a tubular portion 225*a* which is fitted on the stopper lever portion 23 in L-shape as in the second embodiment, and a cover portion 225*b* which is integrally formed with the tubular portion 225*a* and covers the end portion of the spring 22.

When fitting the rubber member 225, the tubular portion 225*a* is fitted on the stopper lever portion 23 before engaging the hook 22*a* of the spring 22 and then the hook 22*a* is inserted into the cover portion 225*b* from the open end thereof and is engaged with the hole 23*a*. The cover portion 225*b* is provided with a notch 22*c* so that the cover portion 225*b* can be spread to facilitate insertion of the hook 22*a*.

This arrangement is advantageous in that the spring 22 is protected from rain and the like entering through the front grill, thereby preventing the spring 22 from rusting.

Further when the inner diameter of the cover portion 225*b* is substantially equal to the outer diameter of the spring 22, vibration of the spring 22 can be suppressed upon impact of the stopper lever portion 23 against the stoppers, thereby suppressing production of noise.

What is claimed is;

1. An engine hood latch mechanism for a vehicle for locking an engine hood of the vehicle in a closed position comprising a striker fixed to the lower surface of the engine hood, a base member having a vertical slit into which the striker is dropped in response to closure of the engine hood, a locking means which engages with the striker in response to drop of the striker into the vertical slit and locks the striker in a closing position where it holds the engine hood in the closed position, a hook lever which has a hook at one end thereof and is mounted for rotation on the base member at the other end thereof by a bearing means, the hook lever being urged by a spring means toward a closing position where the intermediate portion of the hook lever extends along the vertical slit and abuts against the striker in the vertical slit and the hook closes the entrance of the vertical slit, and a stopper means which determines the closing position of the hook lever and limits rotation of the hook lever away from the vertical slit, wherein the improvement comprises that said base member and said hook lever are stamped out from sheet metals, said spring means is connected to the hook lever at a spring connecting portion which is formed on the hook lever such that the spring connecting portion protrudes from the hook lever, said spring connecting portion is formed by bending a part of the hook lever substantially at right angle to the surface of the hook lever, and each of said stoppers is formed by cutting a part of the base member and bending the part substantially at right angle to the surface of the base member, and said stopper means comprises the spring connecting portion and a pair of stoppers which are formed on the base member on opposite sides of the spring connecting portion of the hook lever and are adapted to abut against the spring connecting portion in response to rotation of the hook lever.

2. An engine hood latch mechanism as defined in claim 1 in which said stoppers and the spring connecting portion are arranged relative to each other so that the spring connecting portion abuts against each of the stoppers in surface-to-surface contact.

3. An engine hood latch mechanism for a vehicle for locking an engine hood of the vehicle in a closed position comprising a striker fixed to the lower surface of the engine hood, a base member having a vertical slit into which the striker is dropped in response to closure of the engine hood, a locking means which engages with the striker in response to drop of the striker into the vertical slit and locks the striker in a closing position where it holds the engine hood in the closed position, a hook lever which has a hook at one end thereof and is mounted for rotation on the base member at the other end thereof by a bearing means, the hook lever being urged by a spring means toward a closing position where the intermediate portion of the hook lever extends along the vertical slit and abuts against the striker in the vertical slit and the hook closes the entrance of the vertical slit, and a stopper means which determines the closing position of the hook lever and limits rotation of the hook lever away from the vertical slit, wherein the improvement comprises that said spring means is connected to the hook lever at a spring connecting portion which is formed on the hook lever such that the spring connecting portion protrudes from the hook lever, said stopper means comprises the spring connecting portion and a pair of stoppers which are formed on the base member on opposite sides of the spring connecting portion of the hook lever and are adapted to abut against the spring connecting portion in response to rotation of the hook lever; and a damper member is fitted on the spring connecting portion of the hook lever so that the spring connecting portion abuts against each of the stoppers with the damper member interposed therebetween.

4. An engine hood latch mechanism as defined in claim 3 in which said spring means is connected to the spring connecting portion with the damper member intervening therebetween.

5. An engine hood latch mechanism as defined in claim 3 in which said damper member is fitted on the spring connecting portion in L-shape to cover the spring connecting portion and a part of the hook lever from which the spring connecting portion is bent.

6. An engine hood latch mechanism as defined in claim 5 in which said damper member is provided with a tubular cover portion which covers the part of the spring near the spring connecting portion.

7. An engine hood latch mechanism as defined in claim 6 in which the inner diameter of the cover portion is substantially equal to the outer diameter of the spring means.

8. An engine hood latch mechanism for a vehicle for locking an engine hood of the vehicle in a closed position comprising a striker fixed to the lower surface of the engine hood, a base member having a vertical slit into which the striker is dropped in response to closure of the engine hood, a locking means which engages with the striker in response to drop of the striker into the vertical slit and locks the striker in a closing position where it holds the engine hood in the closed position, a hook lever which has a hook at one end thereof and is mounted for rotation on the base member at the other end thereof by a bearing means, the hook lever being urged by a spring means toward a closing position where the intermediate portion of the hook lever extends along the vertical slit and abuts against the striker in the vertical slit and the hook closes the entrance of the vertical slit, and a stopper means which determines the closing position of the hook lever and limits rotation of the hook lever away from the vertical slit, wherein the improvement comprises that said spring means is connected to the hook lever at a spring connecting portion which is formed on the hook lever such that the spring connecting portion protrudes from the hook lever, said stopper means comprises the spring connecting portion and a pair of stoppers which are formed on the base member on opposite sides of the spring connecting portion of the hook lever and are adapted to abut against the spring connecting portion in response to rotation of the hook lever; and a damper member is fitted on each of the stoppers so that the spring connecting portion abuts against each of the stoppers with the damper member interposed therebetween.

9. An engine hood latch mechanism for a vehicle for locking an engine hood of the vehicle in a closed position comprising a striker fixed to the lower surface of the engine hood, a base member having a vertical slit into which the striker is dropped in response to closure of the engine hood, a locking means which engages with the striker in response to drop of the striker into the vertical slit and locks the striker in a closing position where it holds the engine hood in the closed position, a hook lever which has a hook at one end thereof and is mounted for rotation on the base member at the other end thereof by a bearing means, the hook lever being urged by a spring means toward a closing position where the intermediate portion of the hook lever extends along the vertical slit and abuts against the striker in the vertical slit and the hook closes the entrance of the vertical slit, and a stopper means which determines the closing position of the hook lever and limits rotation of the hook lever away from the vertical slit, wherein the improvement comprises that said spring means is connected to the hook lever at a spring connecting portion which is formed on the hook lever such that the spring connecting portion protrudes from the hook lever, said stopper means comprises the spring connecting portion and a pair of stoppers which are formed on the base member on opposite sides of the spring connecting portion of the hook lever and are adapted to abut against the spring connecting portion in response to rotation of the hook lever, and the edge portion of said hook lever is bent substantially at a right angle along the intermediate portion thereof and the hook lever abuts against the striker in the vertical slit at the side of the bent portion facing the vertical slit.

10. An engine hood latch mechanism as defined in claim 9 in which the edge portion of said hook lever is bent substantially at right angle at a portion opposed to the bearing means of the hook lever, and the bent portion opposed to the bearing means merges into the bent portion along the intermediate portion of the hook lever.

11. An engine hood latch mechanism as defined in claim 9 in which said side of the bent portion facing the vertical slit is provided with an antirust low friction coefficient layer.

* * * * *